US005657776A

United States Patent [19]

Espenschied

[11] Patent Number: 5,657,776

[45] Date of Patent: Aug. 19, 1997

[54] HAIR STITCHING SHAFT FOR DECORATING HAIR

[76] Inventor: Betty R. Espenschied, 4850 Brenner Rd., Freeburg, Ill. 62243

[21] Appl. No.: 509,447

[22] Filed: Jul. 31, 1995

[51] Int. Cl.[6] ..... A45D 8/34

[52] U.S. Cl. ..... 132/212; 132/200

[58] Field of Search ..... 132/200, 273, 132/275, 212, 321; 223/99, 102, 103

[56] References Cited

U.S. PATENT DOCUMENTS

| | | | |
|---|---|---|---|
| 2,740,568 | 4/1956 | Ostergaard | 223/102 |
| 4,307,908 | 12/1981 | Donaldson | 132/200 |
| 4,667,860 | 5/1987 | Feuerman | 223/102 |
| 4,720,026 | 1/1988 | Feuerman | 223/99 |
| 5,036,870 | 8/1991 | Edmark | 132/273 |
| 5,167,245 | 12/1992 | Harriett | 132/273 |
| 5,183,063 | 2/1993 | Ringle et al. | 132/321 |
| 5,289,834 | 3/1994 | Lawrence | 132/212 |
| 5,417,230 | 5/1995 | Wood | 132/212 |

FOREIGN PATENT DOCUMENTS

| | | | |
|---|---|---|---|
| 1043297 | 2/1989 | Japan | 223/102 |
| 2276542 | 10/1994 | United Kingdom | 132/273 |

*Primary Examiner*—Todd E. Manahan

[57] ABSTRACT

A long, pointed hair stitching shaft is presented for decorating hair with a scarf or similar decorative item. The shaft is approximately 5½ inches long, ⅛ inch thick and is pointed at both ends. One end of a scarf is inserted through a diamond-shaped aperture eyelet near one end of the shaft and is snugly secured to the long shaft due to the pointed apex of the diamond aperture eyelet. The scarf may then be pulled through the hair in many decorative and ornamental patterns. Since the shaft is pointed at both ends, the direction of travel of the shaft may be charged in order to create many different ornamental and decorative patterns of the scarf as it is threaded through the hair. This long shaft may be used to thread scarves, ribbons, or other cloth material through long or short hair, through one or two ponytails, or through a wide variety of hair styles depending upon the preference of the user.

5 Claims, 3 Drawing Sheets

HAIR STITCHING SHAFT FOR DECORATING HAIR

BACKGROUND OF THE INVENTION

This invention relates to the field of hairstyling. More particularly, it relates to a shaft used to stitch scarves or other ornamental decorative items through hair.

In the hairdressing field, there have been many different types of devices designed to make the hair look more attractive or decorative. Some of these devices involve clips or comb-like devices which may be attached to the hair in many decorative fashions. Several devices known in the prior art are directed to the ornamental decoration of ponytails.

One such device, entitled "Ponytail Tool", is disclosed in the 1994 United States patent issued to Lawrence, U.S. Pat. No. 5,289,834. The Lawrence device is a tool for facilitating threading a ponytail hairstyle within itself to achieve an attractive appearance. Another similar device is found in the 1991 patent issued to Edmark for a "Hair Styling Tool", U.S. Pat. No. 5,036,870. Both the Lawrence and Edmark device are used to style a ponytail.

While a number of devices in the prior art have thus been devised to manipulate ponytails into an attractive appearance, no device currently known in the hair styling field is used in combination with off-the-shelf scarves or other elongated decorative items in order to create an attractive hair styling decoration. It is an object of this invention to provide a hair stitching shaft capable of threading a scarf or similar item through the hair of an individual.

It is another object of this invention to provide a hair styling shaft with a structure capable of threading a scarf or similar item through hair with the direction of travel of the shaft being completely reversible. It is a still further object of this invention to provide a hair styling shaft for pulling a decorative scarf or similar item through hair regardless of whether the hair is short or long, in a ponytail or bun, or in any other configuration.

Further and other objects of this invention will become apparent upon reading the below Specification.

BRIEF DESCRIPTION OF THE DEVICE

An elongated hair stitching shaft is presented. The hair stitching shaft is approximately 5½ inches long and is pointed at both ends. This elongated shaft is flat rather than round so that the orientation of the shaft as it passes through the hair may be determined by the user. The elongated, pointed, flat shaft has a diamond-shaped eyelet hole at one end to accommodate the insertion of one end of a scarf or other decorative item into the eyelet of the shaft. The scarf or other item is then threaded through the hair in a variety of different patterns so as to create a highly attractive and decorative design.

BRIEF DESCRIPTION OF THE DRAWING FIGURES

DETAILED DESCRIPTION OF THE PREFERRED EMBODIMENT

Figure 1:
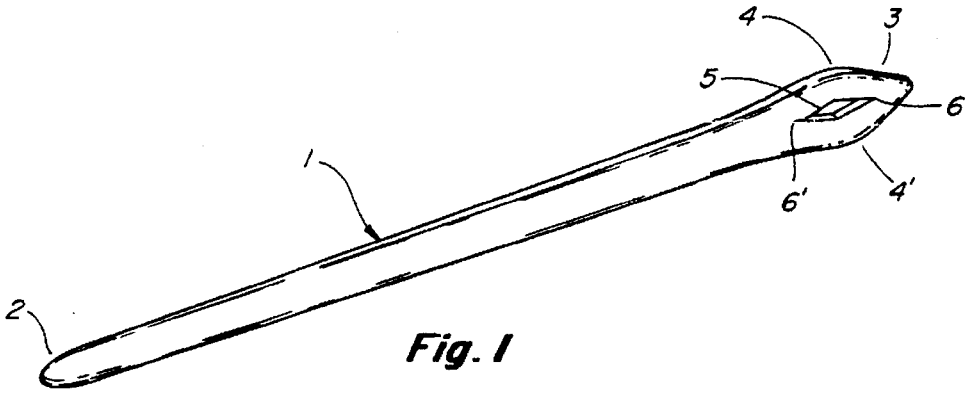
FIG. 1 is a perspective view of the elongated hair stitching shaft.

An elongated hair stitching shaft 1 is best shown in FIG. 1. This elongated hair stitching shaft may be made of any suitable material, however smooth plastic or a smooth and frictionless type of metal such as polished aluminum or brass may also be used.

The hair stitching shaft 1 is elongated as shown with the length of the shaft being ideally between four and six inches. A shaft longer than six inches would be difficult to maneuver through the hair, while a shaft shorter than four inches would be difficult to stick completely through a large mass of hair. The ideal length of the elongated shaft is approximately 5½", although it has been found in practice that a shaft between four and six inches is suitable for the process of decorating hair for which it is designed. The shaft should be flat and thin, with the preferred thickness of the shaft being approximately ⅛".

The elongated shaft has two pointed ends as best shown on FIG. 1. A front pointed end 2 and a rear pointed end 3 both have sharp points to facilitate pushing the shaft through hair. The sharp point is particularly important in case of thick or bristled hair. The sharp point, as contrasted to a round or flat point, is necessary in order to push the elongated shaft some distance through all sorts of hair with a scarf or other decorative item attached to the shaft.

The rear end 3 of the elongated shaft is also sharply pointed but may contain a slight bulge 4 and 4' as shown.

Near the rear end 3 of the elongated shaft 1 is a diamond-shaped cut-out 5, located in the approximate center of the width of the shaft as shown in FIG. 1. The diamond-shaped pattern of the cut-out is considered to be important to this device since the diamond shape creates narrowed converging sides which come to a point 6 and 6'. When inserting the scarf into the diamond-shaped eyelet 5, it is necessary to secure the end of the scarf snugly so that the scarf will not come loose as the elongated shaft is threaded through hair. The narrowed points 6 and 6' of the diamond-shaped eyelet 5 keep the end of the scarf securely attached to the elongated shaft 1 during the stitching process.

Figure 2:
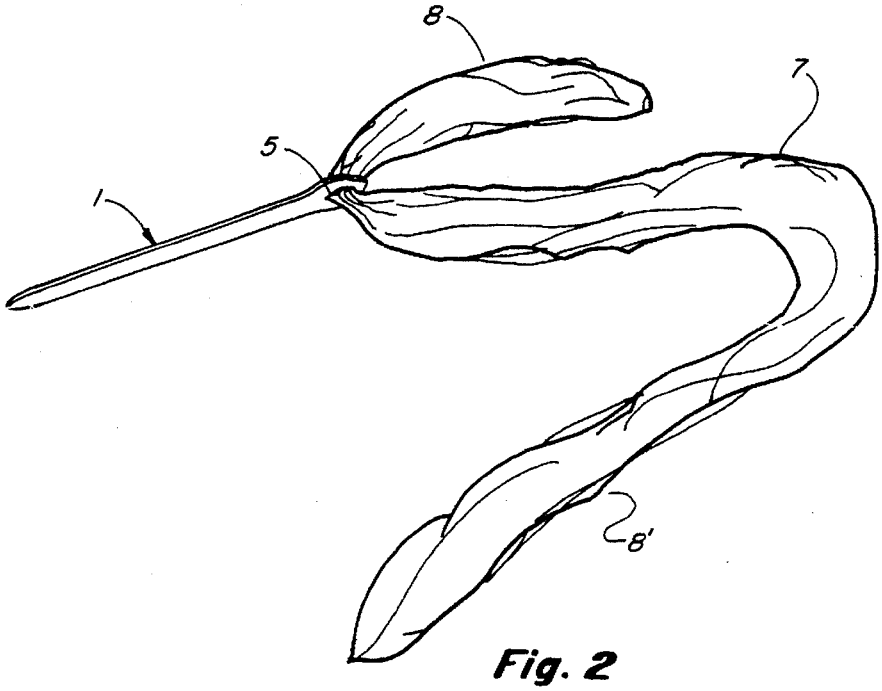
FIG. 2 is a perspective view of the hair stitching shaft showing one end of a decorative scarf threaded through the eyelet of the shaft.

As best shown on FIG. 2, a scarf 7 may be threaded through the eyelet 5 of the elongated shaft 1 in anticipation of stitching the scarf 7 through the hair. The shorter end of the scarf 8 is pulled through the hair by use of the elongated shaft 1 with the longer end of the scarf 8 being threaded through the hair as desired.

Figure 3:
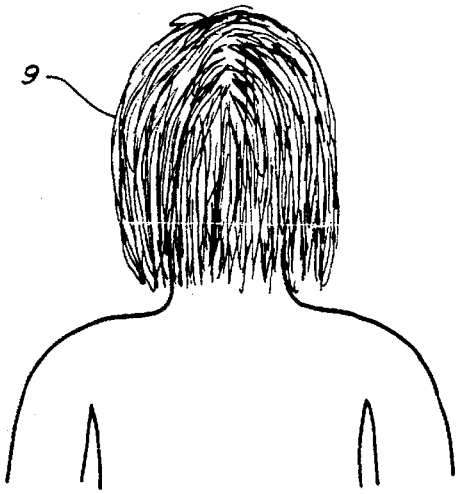
FIG. 3 is a rear view of a person having short hair.
Figure 4:
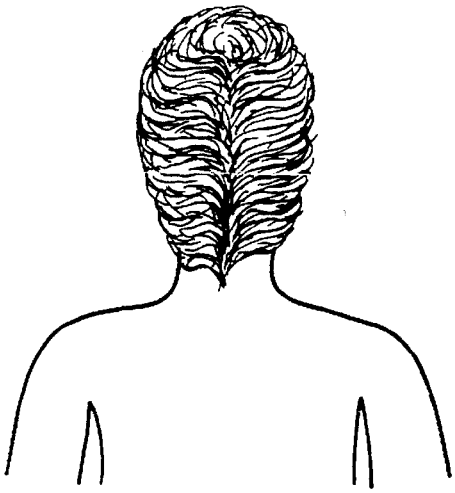
FIG. 4 is a rear view of the person in FIG. 3 showing the short hair combed towards the center of the head.

Turning now to FIG. 3, an individual is shown having relatively short hair 9. One method of styling the short hair shown in FIG. 3 is to comb the sides into the center as best shown on FIG. 4. Once the individual has combed this short hair into the center as shown on FIG. 4, a scarf or other decorative item may be threaded through the hair on the back of the person's head as best shown in FIGS. 5 through 9.

Figure 5:
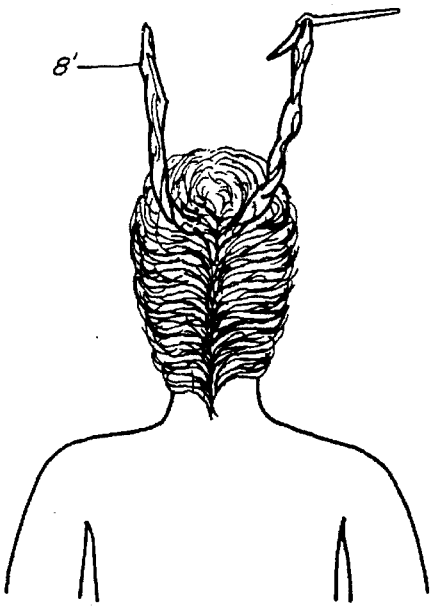
FIG. 5 is a rear view of the person of FIG. 3 showing the first stitch of the shaft as it passes through the combed hair.
Figure 6:
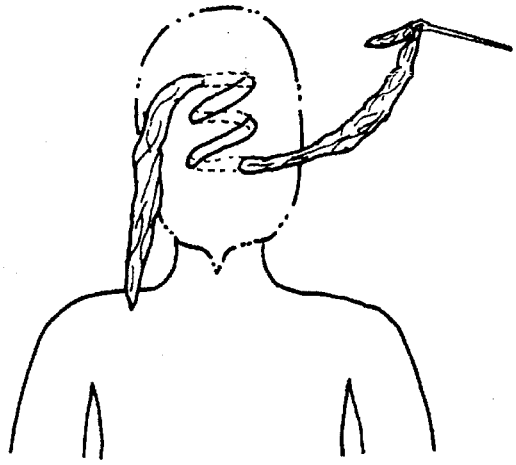
FIG. 6 is a pictorial view of the back of the head of the person in FIG. 3 showing the cross stitching of the scarf.
Figure 7:
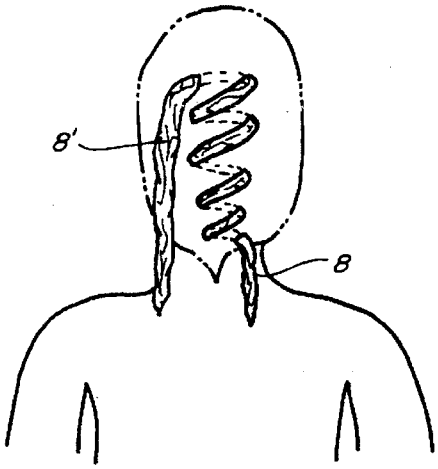
FIG. 7 is a subsequent depiction of the head of FIG. 6 showing additional stitches, with the shaft removed from the end of the scarf.

The first step in utilizing the hair stitching shaft is to thread the shaft 1 and attached scarf 7 through the hair near the upper portion of the head as shown in FIG. 5. Leaving one end 8' a certain decorative length on the left, the elongated shaft attached to the other end of the scarf may be further stitched down diagonally through the hair as shown in FIG. 6. Ultimately, the decorative scarf may appear as shown in FIG. 7 with the opposite ends 8 and 8' as shown pictorially in FIG. 7.

Figure 8:
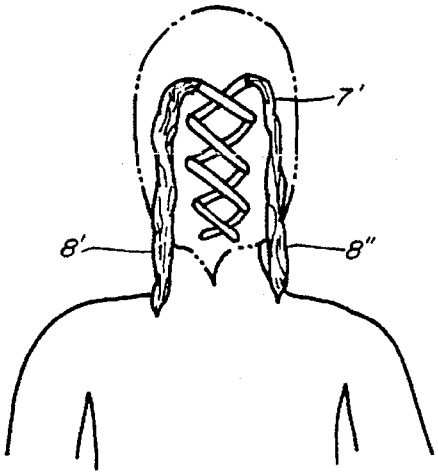
FIG. 8 is a pictorial depiction of the back of the head of the person shown in FIG. 7, showing a second scarf woven through the hair.
Figure 9:
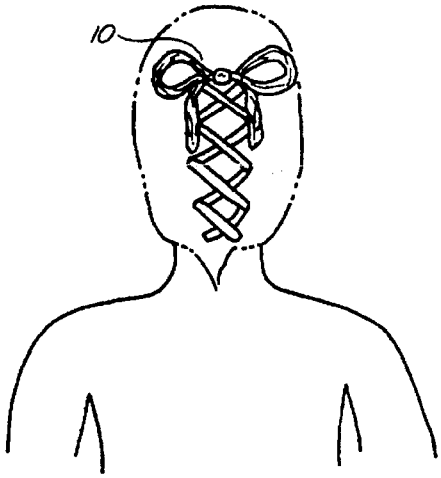
FIG. 9 is a subsequent depiction of the person in FIG. 8, showing the two longer ends of the scarf tied in a bow.

One variation of this particular decorative design achieved by using the elongated, flat, sharply pointed hair styling shaft 1 is to alternately thread a second scarf 7', which may be of a similar or different color, through the hair as shown in FIG. 8. This second scarf 7' has a long end 8" as shown on FIG. 8. This attractive hair style may then be worn as shown in FIG. 8 or the ends 8' and 8" may be tied in a bow 10 as shown in FIG. 9. As may well be appreciated, many different variations of decorative hair styles may be created using the elongated, flat, pointed hair styling shaft 1.

Figure 10:
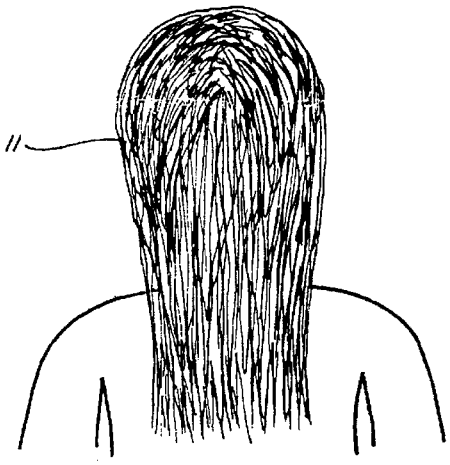
FIG. 10 is a rear view of the hair of a second person having longer hair than that shown in FIGS. 1–9.

A person having longer hair than the person depicted in FIG. 3 is shown in FIG. 10. This longer hair 11 may be decorated with a scarf or similar elongated decorative item using the elongated shaft disclosed herein in many different ways. One such method of decoration is shown in FIGS. 11 through 14.

Figure 11:
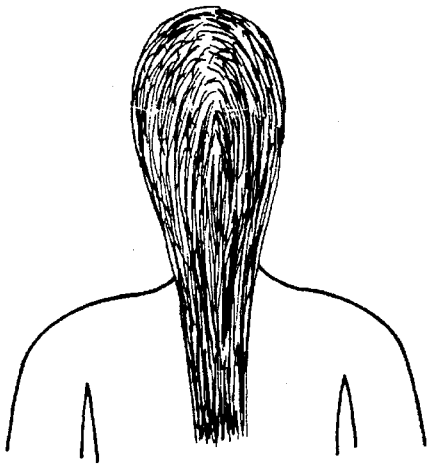
FIG. 11 shows the longer hair of the person in FIG. 10 combed into a single ponytail.
Figure 12:
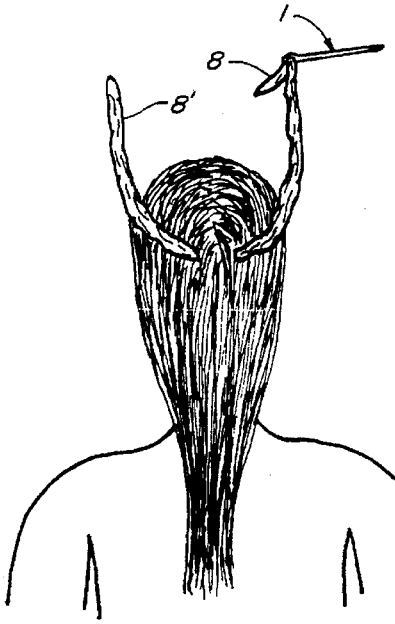
FIG. 12 shows the first stitch of the hair stitching shaft as it threads the scarf through the upper portion of the ponytail shown in FIG. 11.

As shown in FIG. 11, the longer hair 11 may be bunched together to form a loosely styled ponytail. Towards the upper end of the pony tail, the decorative scarf or similar item may be threaded by use of the elongated shaft 1 as shown in FIG. 12. As in FIGS. 5–8, the scarf has a long end 8' and a threaded end 8.

Figure 13:
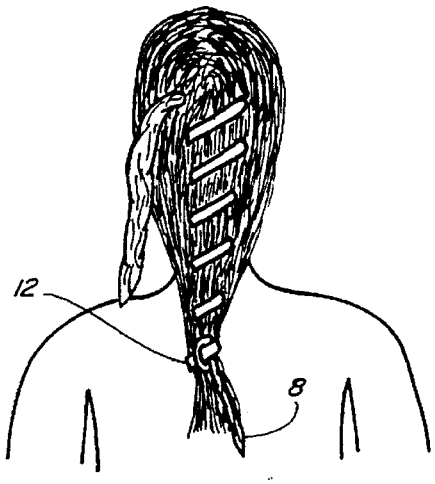
FIG. 13 is a subsequent depiction of the person in FIG. 12, showing six stitches of the scarf through the long ponytail shown in FIG. 12.

The scarf or other decorative item may then be laced diagonally and downwardly through the bunched hair shown in FIGS. 11 and 12 to create the decorative hair styling shown in FIG. 13. Also as shown in FIG. 13, the decoration may be finished by looping the shorter end 8 of the scarf or similar item through the bottom diagonal lace 12 thus tying off the scarf in the manner shown in FIG. 13.

Figure 14:
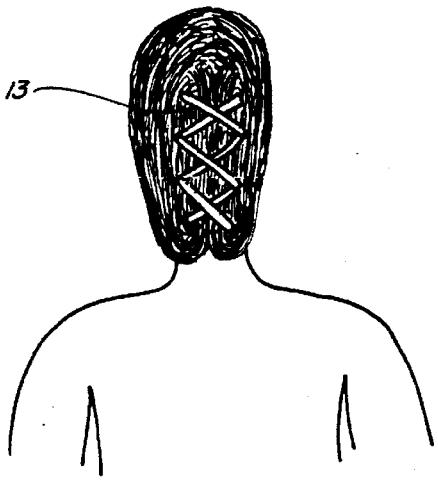
FIG. 14 is a subsequent depiction the hair shown in FIG. 13, with the ponytail turned upwards and with the bottom of the ponytail attached near the upper base of the ponytail.

A final variation of this particular design is shown in FIG. 14. In FIG. 14, the loosely knit longer hair 11 depicted in FIG. 13 is turned upward such that the bottom loop 12 is now near the top center of the head at approximate location 13 shown on FIG. 14. This loosely knit ponytail as shown in FIG. 13 is thus stitched or pinned to create the decorative and attractive hairstyle shown in FIG. 14. A second scarf may also be diagonally stitched through the loosely knit ponytail shown in FIG. 13 to produce the cross-hatching shown in FIG. 14.

As can be appreciated, many different types of decorations or styles may be created Using the elongated, flat shaft shown and described herein. The essential features of the shaft include its elongated general form as well as its sharply pointed ends and diamond-shaped aperture eyelet. As has been previously discussed, the flat shape of the elongated shaft enables the user to feel the directional orientation of the shaft as the scarf or similar item is threaded through the hair. Furthermore, a rounded shaft eyelet has been found to be unsuitable for purposes of this device since a rounded eyelet would not be able to securely hold the end of the scarf and keep it securely fastened to the elongated shaft. Rather, the diamond shaft aperture eyelet enables the scarf to be held securely to the aperture eyelet end of the elongated shaft until it is positively removed by action of the user.

Since this elongated shaft is pointed at both ends, the scarf may be stitched through the hair using either the front end 2 or the rear end 3 as the lead end of the stitching device. Being pointed at both ends, the stitching may be done in many different and innovative patterns to create a most attractive and ornamental design for the wearer.

This elongated stitching shaft is designed for use most particularly with scarves, elongated leather strips, or ribbons. The delicate nature of these items requires that they be capable of being attached to the stitching shaft in the manner described using the diamond-shaped aperture eyelet. It has been found that while rounded apertures may be suitable for shoelaces or other specially made strong materials, the diamond-shaped aperture eyelet is particularly suited for stitching scarves or other delicate materials through hair as shown.

Having fully described my device, I claim:

1. A hair stitching shaft for pulling a scarf or similar ornamental item through hair in a decorative fashion, comprising:

an elongated, essentially flat shaft having a front, pointed penetrating end, a middle, and a rear, pointed threading end;

said rear threading end having a rigid diamond-shaped eyelet cut therefrom, adapted to receive a scarf or similar ornamental item;

wherein said rigid diamond-shaped eyelet comprises four equal sides forming two obtuse and two acute inner angles, said acute angles being located at the center of the width of said shaft;

whereby one part of said scarf or similar item may be inserted through said diamond-shaped eyelet such that said part is wedged in one of said acute angles between said adjacent sides whereby said scarf or similar items is removably but securely attached to said shaft when said shaft is pulled through hair.

2. A hair stitching shaft as in claim 1, wherein the acute angle of said rigid eyelet nearest the very tip end of said threading end creates narrowed converging sides which come to a point, said rigid sides adapted to receive and securely connect said hair stitching shaft to said scarf or other ornamental item.

3. A hair stitching shaft as in claim 1, wherein said shaft is between four and six inches long.

4. A hair stitching shaft for pulling scarves or similar ornamental items through hair as in claim 3, wherein said shaft is approximately ⅛ inch thick.

5. A hair stitching shaft for pulling scarves or similar ornamental items through hair as in claim 4, wherein each end of said shaft has a sharply pointed end.

* * * * *